United States Patent [19]

Rothbard

[11] Patent Number: 4,899,405

[45] Date of Patent: Feb. 13, 1990

[54] ORTHOPEDIC PILLOW

[76] Inventor: Michael Rothbard, 3500 Piedmont Rd. Ste. 105, Atlanta, Ga. 30305

[21] Appl. No.: 332,515

[22] Filed: Mar. 31, 1989

[51] Int. Cl.[4] ..... A47G 9/00

[52] U.S. Cl. ..... 5/434; 5/436

[58] Field of Search ..... 5/434, 436, 431, 435, 5/437, 441, 442; D6/601

[56] References Cited

U.S. PATENT DOCUMENTS

| | | | |
|---|---|---|---|
| 3,400,413 | 9/1968 | La Grossa | 5/436 |
| 4,218,792 | 8/1980 | Kogan | 5/436 |
| 4,320,543 | 3/1982 | Dixon | 5/434 |
| 4,424,599 | 1/1984 | Hannouche | 5/436 |
| 4,432,107 | 2/1984 | Clark et al. | 5/436 |
| 4,494,261 | 1/1985 | Morrow | 5/436 |
| 4,550,459 | 11/1985 | Endel et al. | 5/436 |
| 4,756,035 | 7/1988 | Beier | 5/437 |
| 4,759,089 | 7/1988 | Fox | 5/436 |
| 4,768,246 | 9/1988 | Summer | 5/434 |
| 4,777,855 | 10/1988 | Cohen | 5/434 |

*Primary Examiner*—Alexander Grosz

*Attorney, Agent, or Firm*—Hedman, Gibson, Costigan & Hoare

[57] ABSTRACT

An orthopedic pillow providing support for the head and neck of the user is disclosed. The neck is supported by either of two cylindrical neck bolsters. Either of two convoluted surfaces comprising matrices of pyramid shaped nodes are utilized to give support to and cushion the head.

4 Claims, 1 Drawing Sheet

ORTHOPEDIC PILLOW

FIELD OF THE INVENTION

The present invention relates to an improved orthopedic pillow for supporting the head and neck of a person lying on his side as well as in a supine position.

DESCRIPTION OF THE PRIOR ART

There are various types of orthopedic pillows described in the art which provide some support for the head and neck of a person lying in a horizontal position.

U.S. Pat. No. 4,218,792 (Kogan) describes an orthopedic pillow of generally rectangular shape, the base of the rectangle adjacent to the user's shoulders being formed with a concave curvature, the rectangle block having a depression therein for the user's head. This device forces the user to lay in the supine position and does not allow freedom of movement throughout the sleep cycle.

U.S. Pat. No. 4,494,261 (Morrow) describes a head and neck cushion for use by a person lying in a supine position, consisting of a member which provides support for the neck and a second member which supports the underside of the head.

U.S. Pat. No. 4,424,599 (Hannonche) teaches a cervical pillow which provides corrective support for the head and neck of a person lying in a supine position.

Other examples of orthopedic support pillows to be found in the prior art are shown in U.S. Pat. Nos. 4,320,543; 4,432,107; 4,768,246; 4,756,035; and 4,550,459.

All of the above-mentioned patents are hereby expressly incorporated by reference as if set forth in their entirety within the present specification.

SUMMARY OF THE INVENTION

The principle object of this invention is to provide an orthopedic pillow for providing proper support for the neck and head of a user lying in the horizontal position.

Another object of this invention is to provide such a device which also gives maximum comfort to the user by cushioning the head and distributing the weight of the head over a relatively large surface area.

Still another object of this invention is to provide such a device which enables a user to lay in a supine position as well as on his side, and to provide continuous support for the head and neck if the user moves during the sleep cycle.

In furtherance of these and other objects of the present invention, an improved orthopedic support pillow is described which provides two cylindrical neck bolsters placed opposite each other and joined by a rectangular head rest section. The head rest is a substantially planar structure covered with a convoluted surfaces on both sides which provides proper support and a comfortable cushion for the head. In this manner, the pillow may be used with either side facing up and either end under the neck of the user, which provides for maximum convenience. The pillow is encased by a removable cover made of a washable material and closed by a conventional means such as a zipper.

The orthopedic pillow described herein can be made of various resilient materials which provide support as well as a comfortable cushion, such as polyurethane foam. The shape of this invention is generally rectangular, however, the size of the pillow can vary as desired.

These and other features, objects, and advantages of the present invention will become apparent with reference to the following description and drawings.

DESCRIPTION OF THE PREFERRED EMBODIMENT

Figure 1:
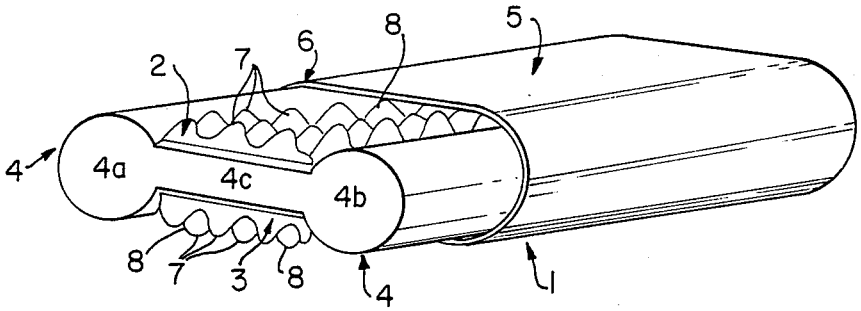
FIG. 1 is a perspective view of the pillow of this invention.
Figure 2:
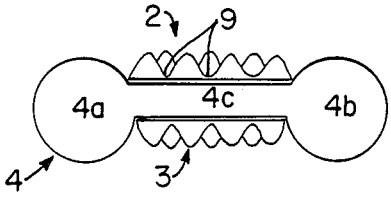
FIG. 2 is a side view of the pillow.
Figure 3:
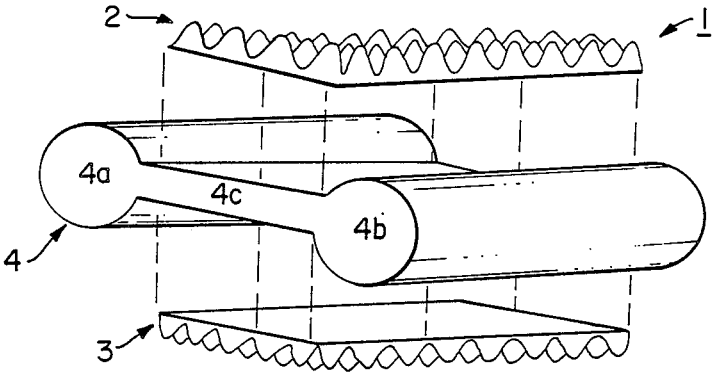
FIG. 3 is an exploded perspective view of the pillow.

Referring to FIGS. 1, 2 and 3, the orthopedic pillow 1 of the present invention is comprised of support member 4, central head rest sections 2 and 3, cover 5 and fastener 6.

The support member 4 is comprised of two longitudinally extending cylindrical neck bolsters **4*a* and 4*b*, and rectangular support section 4*c*. The neck bolsters 4*a* and 4*b* are joined to the long ends of the rectangular support section 4*c* such that the long ends of the rectangular support section 4*c* are perpendicular to each of the neck bolsters 4*a* and 4*b***.

Each of the central head rest sections 2 and 3 are comprised of a multitude of pyramid shaped nodes 7 which are configured with a rounded top 8. The pyramid shaped nodes 7 are arranged in an orderly matrix fashion so as to form a convoluted surface. As best seen in FIG. 2, adjacent rows of nodes 7 are offset to provide nodes 7 of one row in alignment with the depression 9 between the nodes 7 of the adjacent row of nodes 7. This convoluted surface is advantageous insofar as it provides a larger area upon which the head will rest, which aids in relieving pressure points and providing maximum comfort. In addition, the convoluted surface allows more air circulation than would a flat section of foam, which aids in reducing snoring by the user.

The central head rest sections 2 and 3 are joined to the rectangular support section **4*c* along their planar surface. By providing such head rest sections on both sides of the orthopedic pillow 1**, a user can utilize both sides to rest his head upon with equal effectiveness.

Referring to FIG. 1, the orthopedic pillow 1 is encased by the cover 5, which can be made of any material suitable for removing and cleaning. The fastener 6 is attached to the open end of the cover 5 and serves to close the cover 5 around the orthopedic pillow 1 in a conventional fashion. The fastener 6 can be implemented with a standard zipper, drawstring, or the like.

Practice has taught that the pillow of the subject invention that is particularly suitable for orthopedic use is made of polyurethane foam of 1.5 lb. density. The support member 4 should have a firmness measurement of 18–20 ILD, while the central head rest sections 2 and 3 should have a firmness measurement of 12–15 ILD.

Practice has also taught that by constructing the cylindrical neck bolsters **4*a* and 4*b* such that they are five inches in diameter and 22 inches long, the rectangular support section 4*c* such that it is 1½ inches thick x 6½ inches wide x 22 inches long, and the central head rest sections 2 and 3 such that they are 1½ inches thick x 6½ inches wide x 22 inches long, the orthopedic pillow 1 will easily fit into a conventional pillow case. The plane defined by the tops 8 of the nodes 7 is therefore ¼ inch lower than the plane defined by the peaks of the cylindrical neck bolsters 4*a* and 4*b***, which allows the user's head to lay in a natural position with respect to his neck and body. This eliminates the need for specially made pillow cases which are necessitated by the odd shaped pillows described in the prior art.

The orthopedic pillow described herein is superior to the pillows of the prior art due to its versatility in usage. A user can rest his head and neck in both the supine position or while lying on his side. Orthopedic pillows of the prior art contain head shaped concave depressions which limit the user to the supine position, failing to take into account the subconscious movements of a person while he sleeps. In addition, the orthopedic pillow in the present invention is constructed so as to appear to be a conventional pillow and is thereby visually pleasing. Conventional pillow covers can be used, and due to the symmetry of construction, the pillow can be used upside down as can a conventional pillow.

Although there has been shown and described what is considered to be the preferred embodiment of the present invention, it will be appreciated by those skilled in the art that modifications of such embodiments may be made. It is therefore desired that the invention not be limited to this embodiment, and it is intended to cover in the appended claims all such modifications as fall within the true spirit of the invention.

What is claimed is:

1. A reversible, generally rectangular orthopedic pillow for supporting a user's head and neck while a user is lying in a substantially horizontal position comprising:

a member made of resilient material having two elongated cylindrical shaped bolsters of substantially the same size attached to opposite long ends of a generally horizontal rectangular resilient element that connects the bolsters to each other, having generally planar upper and lower surfaces, and a thickness smaller than the diameters of the bolsters, thereby defining an upper and lower cavity;

two generally rectangular resilient cushions, each being substantially the same size as said planar surfaces, each consisting of a multitude of pyramid shaped nodes arranged in a matrix fashion on one side, each cushion being joined to a respective upper and lower surface of the resilient element, within the respective cavities so as to expose said pyramid shaped nodes, whereby a user can rest his or her head on either cushion while supporting his or her neck on either of said bolsters and yield maximum support and comfort.

2. An orthopedic pillow according to claim 1, wherein said resilient material is polyurethane foam.

3. An orthopedic pillow according to claim 1, additionally comprising:

a removable cover; and a fastener attached to the open end of said cover whereby said cover can be removed from said pillow or secured thereto.

4. An orthopedic pillow according to claim 1 further comprising rounded tops on each pyramid shaped node and wherein the nodes of one row of nodes are aligned with the depressions between the nodes of the adjacent row.

* * * * *